United States Patent [19]

Hermans

[11] 4,055,877

[45] Nov. 1, 1977

[54] METHOD OF MANUFACTURING A CATHODE RAY TUBE

[75] Inventor: Peter Hermans, Eindhoven, Netherlands

[73] Assignee: U.S. Philips Corporation, New York, N.Y.

[21] Appl. No.: 665,958

[22] Filed: Mar. 11, 1976

[30] Foreign Application Priority Data

Mar. 18, 1975 Netherlands ..... 7503177

[51] Int. Cl.[2] ..... H01J 9/18

[52] U.S. Cl. ..... 29/25.16; 316/19

[58] Field of Search ..... 29/25.15, 25.16, 25.19; 316/19, 31

[56] References Cited

U.S. PATENT DOCUMENTS

| | | | |
|---|---|---|---|
| 2,680,824 | 6/1954 | Beggs | 316/31 |
| 3,504,412 | 4/1970 | Kraner et al. | 29/25.16 |
| 3,520,040 | 7/1970 | Munday et al. | 29/25.16 |

*Primary Examiner*—Richard B. Lazarus

*Attorney, Agent, or Firm*—Frank R. Trifari

[57] ABSTRACT

In the manufacture of cathode ray tubes, the neck of the tube consisting of a lead-containing glass is closed by a glass base plate having sealed therein a number of contact pins on which an electrode system for generating at least two electron beams is mounted. The periphery of the base plate is sealed to the wall of the neck of the tube by local heating, the base plate being supported by a supporting member having guide holes and reference holes cooperating with the contact pins to determine the centering and the rotational position of the electrode system relative to a reference system of axes. In order to prevent (or inhibit) the lead released from the lead-containing glass during sealing from penetrating into the reference holes, said reference holes are substantially spaced from the base plate. This is realized in a simple manner by means of a supporting member in which each reference hole is coaxial with a guide hole and spaced from the surface of the member supporting the base plate.

2 Claims, 5 Drawing Figures

METHOD OF MANUFACTURING A CATHODE RAY TUBE

The invention relates to a method of manufacturing a cathode ray tube having a tubular neck. Particularly, a lead-containing glass is closed by a glass base plate having sealed therein a number of contact pins, arranged in a circle, and on which an electrode system for generating at least two electron beams is mounted. A periphery base plate is sealed to the wall of the neck while being supported, in a position accurately referred to certain reference parts of the tube, by a supporting member having guide holes and reference holes. These reference holes cooperate with the contact pins to determine the rotational position of the electrode system about its longitudinal axis.

The invention further relates to a device for carrying out the foregoing method and to a cathode ray tube manufactured by the foregoing method.

In the manufacture of cathode ray tubes having an electrode system for generating at least two electron beams, as for example in color television display tubes, the accuracy with which the electrode system is positioned in the envelope of the tube is subject to stringent requirements. In a color television display tube, only small tolerances are permissible in the centering and the rotational position of the electrode system relative to a reference system of axes.

In a conventional method, the electrode system is first mounted on the contact pins of the tube which extend through and are sealed in the glass base plate. In doing so, the electrode system is oriented with respect to two contact pins which are used as reference pins. The resulting assembly is then inserted into the neck of the tube, the base plate being supported by a supporting member having guide holes and reference holes in which the contact pins are inserted. The guide holes provide a rough positioning and the reference holes provide an accurate positioning of the electrode system about its longitudinal axis. The supporting member, sometimes termed a sealing pin, is accurately oriented relative to a number of reference surfaces on the envelope of the tube. The desired orientation of the electrode system in the envelope of the tube is obtained by causing the contact pins already used as reference pins to cooperate with the reference holes in the supporting member. The wall of the neck of the tube is then fused to the periphery of the glass base plate by local heating.

In order to fix the rotational position of the electrode system about its longitudinal axis as accurately as possible, the amount of play with which the reference pins fit in the reference holes of the supporting member should be as small as possible. However, with only a small amount of play, the following problem arises. In order to obtain certain desired properties, for example ray absorption, the glass of the neck of the tube and the base plate contains a considerable proportion of lead. During fusing of the base plate to the neck of the tube, some of this lead is released from the surface of the glass and adheres, in the form of lead oxide, to the surface of the supporting member supporting the base plate. In known supporting members, the guide holes and reference holes which cooperate with the contact pins are formed in the supporting surface of the supporting member. Consequently, if the supporting member is used frequently, the diameter of the reference holes will be reduced after a short period of time by the deposition of the lead oxide to such an extent that the reference pins of the base plate will no longer fit in the reference holes.

According to the invention this drawback is alleviated if during the sealing of the periphery of the base plate to the wall of the neck of the tube, at least the reference holes are spaced from the glass base plate. In this manner, lead released from the glass of the neck of the tube and of the base plate is inhibited from penetrating into the reference holes. With respect to the guide holes in the supporting member, it should be noted that it is not essential that these holes also be longitudinally spaced from the base plate, since these holes only play a small part in centering and determining the rotational position of the electrode system. Therefore the diameter of the guide holes may be chosen to be larger than the diameter of the reference holes.

According to a further aspect of the invention, keeping the reference holes spaced from the glass base plate can be carried out very efficaciously by using a device which comprises a supporting member having a supporting surface for the base plate of the tube and further having reference holes and guide holes cooperable with the contact pins projecting from the base plate, each of the reference holes being coaxial with a guide hole and spaced from the surface.

Suitably, the supporting member comprises a first ring portion for supporting the base plate and having the guide holes therein, and a second ring portion axially spaced by a short distance from said first ring and having the reference holes therein.

The invention will be described in greater detail with reference to the drawings, in which.

Figure 2:
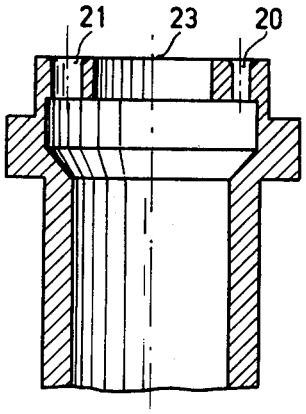
FIG. 2 is a longitudinal sectional view of a known type of supporting member or sealing pin.
Figure 3:
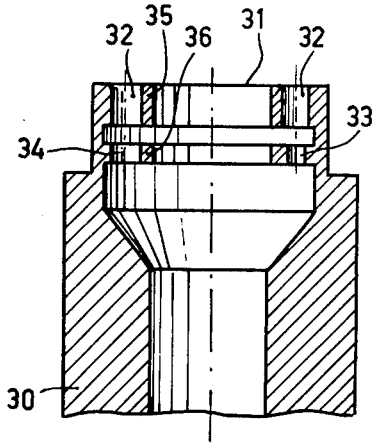
Figure 2A:
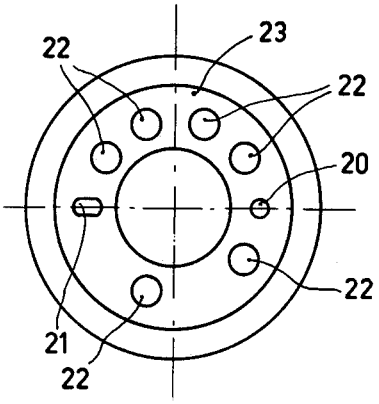
Figure 3A:
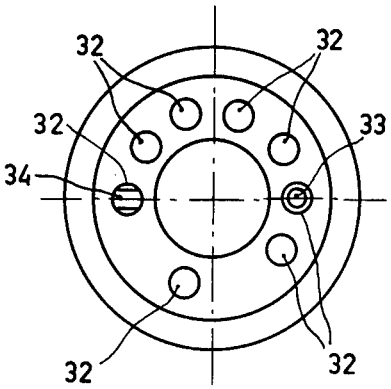

FIG. 2*a* is a plan view of the supporting member shown in FIG. 2;

FIG. 3 is a longitudinal sectional of a supporting member or sealing pin embodying the invention, and FIG. 3*a* is a plan view of the supporting member shown in FIG. 3.

Figure 1:
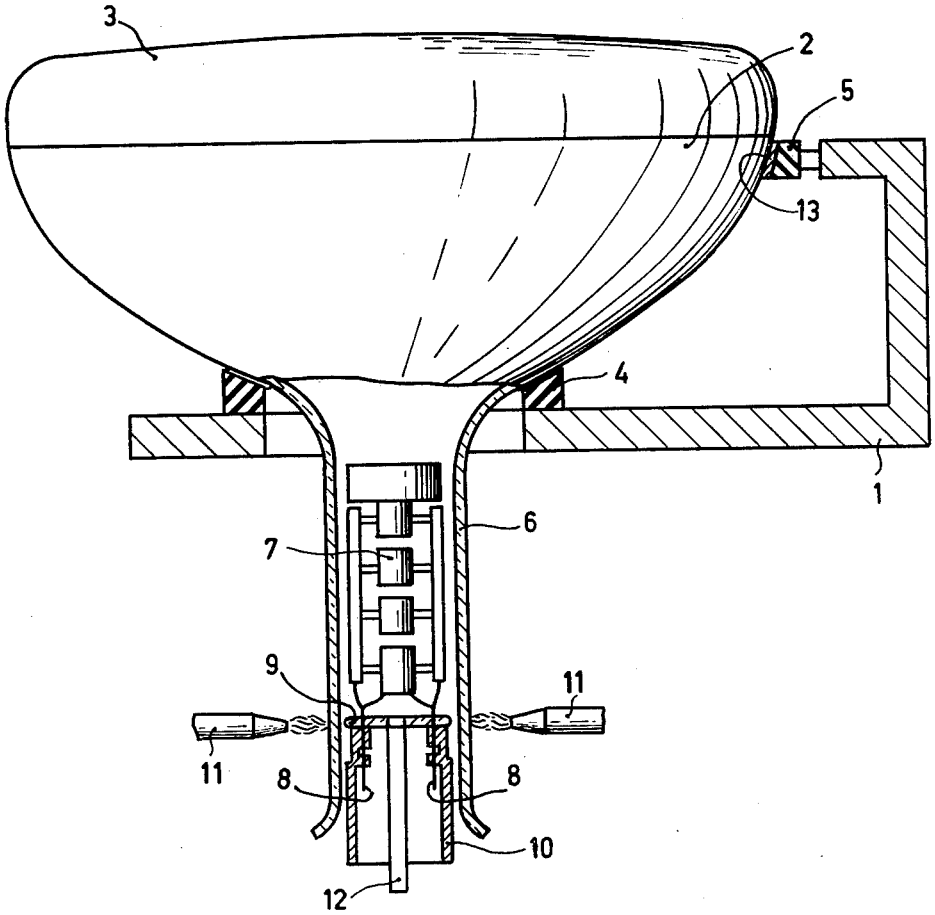
FIG. 1 shows, partly diagrammatically, a cathode ray tube and an arrangement for mounting an electrode system in the envelope of the cathode ray tube.

The arrangement shown in FIG. 1 comprises an envelope holder 1 which supports a glass envelope 2 of a color television display tube having a substantially rectangular display window 3. The orientation of the envelope 2 relative to the holder 1 is determined by a supporting ring 4 and two abutment members 5, which in the drawing are situated behind each other and which press against reference surfaces 13 on a long side of the rectangular portion of the envelope 2. An electrode system 7 consisting of three electron guns for generating three electron beams in a plane at right angles to the plane of the drawing is inserted into the open end of the neck 6 of the tube. The electrode system 7 is mounted on a number of contact pins 8 which are sealed in a circle in a glass base plate 9 and which have a diameter of 1.00 mm with a tolerance of $\pm$ 0.02 mm. The glass base plate 9 is supported by a metal supporting member or sealing pin 10, the rotational position of which about its longitudinal axis is coupled to the position of the abutment members 5. The contact pins 8 are inserted into guide holes and reference holes in the supporting member 10, as a result of which the rotational position of the electrode system about its longitudinal axis with respect to the rectangular display screen 3 is also determined. Having thus fixed the position of the electrode system 7 in the envelope 2, the periphery of the base plate 9 is sealed to the wall of the neck 6 of the tube by means of burners 11, after which the envelope is finally evacuated via an exhaust tube 12. During sealing, the neck of the tube which consists of a glass containing approximately 36% by weight of lead, is heated locally to a temperature of 800° C – 900° C. Some of the lead is released from the glass and is deposited in the form of lead oxide on the part of the supporting member 10 supporting the base plate. The use of a supporting member as shown in FIGS. 2 and 2*a* results in the lead oxide also being deposited on the walls of the guide holes 22 and reference holes 20 and 21 extending from the supporting face 23. The guide holes 22 have a diameter of 2mm with a tolerance of ± 0.1 mm. The cylindrical reference hole 20 and the diametrically opposite slotted reference hole 21 have a diameter and width, respectively, of 1.10 mm with a tolerance of only ± 0.02 mm. The play between the reference pins and the wall of the reference holes is thus approximately 0.1 mm. With reference holes diametrically spaced by 20.3 mm, the tolerance in the rotational position of the electrode system is then approximately 24'. The smaller the play, the more accurately is the rotational position of the electrode system determined. Since there is only a small amount of play, the deposition of the lead oxide in the reference holes will result in the reference pins no longer fitting in the reference holes after a short time if the supporting member is frequently used. This drawback is alleviated with a supporting member as shown in FIGS. 3 and 3*a*. This supporting member consists of a chromium-nickel-steel hollow pin 30 having a supporting surface 31 formed by an axial end face of a first ring portion 35. This first ring portion 35 comprises only guide holes 32. The reference holes are a cylindrical hole 33 and a slotted hole 34 in a second ring portion 36.2 mm below the first ring portion 35. The space between the reference holes and a base plate placed on the supporting member prevents lead oxide from being deposited on the walls of the reference holes during the sealing process. Consequently, there can be a smaller amount of play between the reference pins and the reference holes than in a known supporting member. In the embodiment of FIGS. 3 and 3*a*, the guide holes again have a diameter of 2 mm, but the reference hole 33 by which the centering of the electrode system is determined has a diameter of 1.05 mm with a tolerance of ± 0.02 mm, and the width of the slotted hole 34 is also 1.05 mm.

It has been found that when using a supporting member embodying the invention, a more favorable stress distribution is obtained during the sealing process, reducing the possibility of a crack in the glass, than when using a known supporting member. This is ascribed to the fact that in a supporting member embodying the invention, the heat exchange between the contact pins and the supporting member near the base plate is distributed uniformly over each contact pin because all contact pins, including the reference pins, fit in the guide holes 32 with the same large amount of play. Furthermore, owing to the smaller play which can be permitted between the reference pins and the walls of the reference holes, the rotational position of the electrode system when using a supporting member embodying the invention can be more accurately determined than when using a known supporting member.

I claim:

1. A method of manufacturing a cathode ray tube having a tubular neck of a lead-containing glass, including the steps of closing said tube by a glass base plate having sealed therein a number of contact pins which are arranged in a circle and on which base plate an electrode system for generating at least two electron beams is mounted, and sealing the periphery of said base plate to the wall of said neck by heating while supporting said base plate in a position accurately referred to a predetermined reference system of axes by a supporting member, said supporting member having guide holes and reference holes positioned with respect to said contact pins to determine the rotational position of the electrode system about its longitudinal axis with respect to the reference system of axes, the improvement comprising the step of sealing the edge of said base plate to said wall of said tube neck with said reference holes spaced from said base plate, thereby inhibiting deposition of lead released from said lead containing glass onto the walls of said reference holes.

2. The method of claim 1 wherein said guide hole diameters are larger than said reference hole diameters.

* * * * *